US005670216A

United States Patent [19]

Oak et al.

[11] Patent Number: 5,670,216

[45] Date of Patent: Sep. 23, 1997

[54] COOKING UNTENSIL, INTERMEDIATE LAYER FOR NON-STICK COATING OF A COOKING UNTENSIL, AND METHOD

[75] Inventors: Albert Charley Oak, West Bend; Leonard C. Brumbaugh, Neenah; Daryl E. Crawmer, Appleton, all of Wis.

[73] Assignee: Regal Ware, Inc., Kewaskum, Wis.

[21] Appl. No.: 280,024

[22] Filed: Jul. 25, 1994

Related U.S. Application Data

[63] Continuation-in-part of Ser. No. 121,113, Sep. 13, 1993, abandoned.

[51] Int. Cl.[6] ..... C23C 4/08

[52] U.S. Cl. ..... 427/455; 427/388.1; 427/405; 427/409; 427/449; 427/456; 420/34; 420/77; 420/79; 420/103

[58] Field of Search ..... 427/455, 456, 427/449, 409, 405, 388.1; 420/34, 77, 79, 103

[56] References Cited

U.S. PATENT DOCUMENTS

| | | | |
|---|---|---|---|
| 3,942,230 | 3/1976 | Nalband | 117/75 |
| 4,859,649 | 8/1989 | Böhnke et al. | 502/439 |
| 5,069,937 | 12/1991 | Wall | 427/227 |

*Primary Examiner*—Shrive Beck
*Assistant Examiner*—David M. Maiorana
*Attorney, Agent, or Firm*—Wheeler Kromholz & Manion

[57] ABSTRACT

The present invention comprises a method for preparing a surface for application of a non-stick coating, the method wherein the surface to be prepared for non-stick coating is prepared by thermally spraying a stainless steel alloy containing at most 6.0% aluminum, and is substantially free of Nickel. The present invention further includes a cooking utensil having a substrate to which an intermediate layer, for receiving the non-stick coating, is prepared by thermally spraying the stainless steel alloy containing at most 6.0% aluminum, and is substantially free of Nickel.

14 Claims, No Drawings

COOKING UNTENSIL, INTERMEDIATE LAYER FOR NON-STICK COATING OF A COOKING UNTENSIL, AND METHOD

This is a continuation-in-part of Ser. No. 08/121,113, filed 13 Sep. 1993, now abandoned.

BACKGROUND OF THE INVENTION

The present invention relates generally to the field of arc spraying or flame spraying, typically both referred to as thermal spraying and specifically to thermal spraying, an intermediate layer of material on stainless steel or aluminum cooking vessels in order to prepare the cooking surface of the cooking vessel for receiving a non-stick coating layer.

Application of non-stick coatings to cooking vessels is well known. Adhesion of the non-stick coating (e.g. non-stick coatings such as the TEFLON brand non-stick coating) layer applied to a substrate metal applied is improved by first flame spraying metal droplets onto the substrate layer to give a rough surface for the non-stick coating to adhere to. However, this coating can break down typically due to corrosion between the substrate metal of the cooking vessel and the thermal sprayed intermediate layer (galvanic corrosion) or as the result of cooking high add content food (e.g. stewed tomatoes) at relatively high cooking temperatures; i.e. electrolytic corrosion.

Accordingly, metals that are subject to corrosion in combination with a thermally sprayed intermediate layer, like a stainless steel alloy of a specific composition, are considered not suitable intermediate layers for this technique because of the risk of corrosion; e.g. with aluminum pans there is the potential for white rust corrosion, i.e. the formation of aluminum oxides within the coating layers. Corrosion causes blistering of the non-stick surface and causes the non-stick surface to pull away from the cooking vessel or utensil.

The present invention is a new method of application of a material to substrates, such as aluminum and stainless steel, of cooking vessels that typically are thought to be unacceptable for the thermal spraying technique.

The present invention is a unique and simple method for application of a thermally sprayed layer to a substrate of a cooking vessel for formation of an intermediate layer to improve adhesion of a non-stick coating to the cooking utensil without creating galvanic or electrolytic corrosion.

The inventor knows of no prior art which either teaches or discloses his invention. For example U.S. Pat. No. 5,069,937 (Wall) discloses thermal spraying of stainless steel with a material containing an extremely high chromium level. However the present method applies an effective and corrosion resistant intermediate layer without the use of the high levels of chromium taught by Wall and by adding aluminum to the stainless steel alloy contrary to Wall. Further, the formulation of the present invention does not require a stainless steel alloy formulation containing Nickel in any substantial amount. Other prior art of note known to the applicant but not teaching the present invention is U.S. Pat. No. 4,859,649 (Bohnke). Also, the wire used in the process of the present invention has been known for industrial application for at least thirty years but has never, to the applicant's knowledge been used for the process or product disclosed and claimed herein.

DEFINITION OF TERMS

For the purposes of clarity the terms given below shall be interpreted throughout the specification and the claims as having the following definitions. Should there be any contradiction between the meaning given a term herein and its common meaning that term shall be interpreted as having both meanings.

Thermal Spraying—Any method of applying the material disclosed and claimed herein to a desired surface by causing: 1. The material to melt in an electric arc and then blowing the melted material onto the desired surface. 2. The material to be reduced to a molten state in a flame and blown onto the desired surface by the flame. Further, for the purpose of this disclosure, thermal spraying as used herein shall also include the meaning of the terms flame spraying and arc spraying.

Substantially Nickel Free—As used herein this means any material suitable for use in the process disclosed herein and having no more than 0.2% nickel.

SUMMARY OF THE INVENTION

The present invention comprises a process or method for preparing a cooking utensil surface for application of a non-stick coating, the process in which the surface to be prepared for non-stick coating is prepared by thermally spraying an intermediate layer of a substantially Nickel free stainless steel alloy containing at most 6.0% aluminum onto the cooking utensil surface; e.g. the interior of a cooking vessel. Further, the present invention could preferably include chromium levels as high as 23.5%.

The present invention further encompassing a cooking utensil having a substrate, e.g., the interior bottom of the pan or pot prior to coating it with a non-stick coating, and an intermediate layer deposited on the substrate by thermally spraying the substrate with a substantially Nickel free stainless steel alloy containing at most 6.0% Aluminum. Again, the substantially Nickel free stainless steel alloy would preferably include at most 23.5% chromium. The intermediate layer thus applied providing a coating to the substrate layer for receiving a non-stick coating such as TEFLON brand non-stick coating.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention is a new method of applying a stainless steel alloy formulation for making a wire. The new method is for use in thermal spraying of the stainless steel alloy that forms the wire onto a cooking vessel substrate surface in order to prepare that cooking vessel substrate surface for the application of a non-stick coating. Consequently, the material applied by the method of the present invention forms an intermediate coating or surface in the form of thermally sprayed droplets or particles on the cooking utensil substrate, thereby creating a rough surface, for improved adhesion of the non-stick coating surface.

It should be noted that the intermediate layer applied by the method of the present invention is not necessarily a contiguous or integral layer but simply may consist of a pattern of droplets or particles sprayed onto the desired cooking utensil surface.

The intermediate layer material applied by the method of the present invention substantially reduces if not eliminates, corrosion between the substrate metal of the cooking vessel and the thermally sprayed intermediate surface material thereby preventing the destruction of the intermediate surface through corrosion, thereby preventing blistering of the non-stick coating.

The stainless steel alloy applied by the method of the present invention having the formulation of 3.5–6.0% Aluminum (Al), 14–23.5% Chromium (Cr), 0.45% (maximum) Manganese (Mn), 0.65% (maximum) Silicon (Si), 0.055% (maximum) Carbon (C), and 70.35–74.35 parts Iron (Fe). The melting point of this composition has been found to be 2,770° F.

Addition of Nickel is not believed to be desirable as this would change the melting point and change the reaction of the metal alloys. Accordingly, the method of the present invention uses a stainless steel alloy that is substantially Nickel free.

The present invention substantially reduces corrosion caused by the cooking of certain foods, causing blistering and coating failure, as well as preventing galvanic reaction between the intermediate flame sprayed layer and the cooking substrate. Consequently, a superior intermediate layer for improved adhesion of a non-stick coating is applied. Further, unlike other prior art materials, the wire used for the unique method of the present invention is of a relatively inexpensive standard type requiring no special additional materials such as Zirconium, Titanium, silicon, manganeses, molybdenum, zirconium, titanium, nitrogen, calcium, magnesium, nitrogen, or rare earth metals to achieve the corrosion resistance achieved by the new process disclosed herein. The present invention achieves reduced corrosion without the need for the expensive or special additives disclosed supra. Further, the inventor knows of no prior art which teaches either process or product (cooking utensil) disclosed herein for the particular application disclosed herein.

The present method is practiced by thermally spraying the stainless steel alloy of the above noted formulation onto the desired surface, in particular the substrate surface of a cooking vessel that needs to be prepared to receive a coating of non-stick material. It should be emphasized that use of a stainless steel alloy having substantially no Nickel is not suggested by the prior art. Further, the use of an alloy containing the proportions of aluminum or chromium given herein is also not taught by the prior art.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A method for preparing a surface for application of a non-stick coating, the method in which the surface to be prepared for non-stick coating is thermally sprayed with a substantially Nickel free stainless steel alloy containing at most 23.5% Chromium and at most 6.0% Aluminum.

2. The method of claim 1 wherein the substantially Nickel free stainless steel alloy contains from 14–23.5% chromium by weight.

3. The method of claim 1 wherein the substantially Nickel free stainless steel alloy contains from 3.5–6.0% by weight of aluminum.

4. A method for preparing a surface for application of a non-stick coating, the method wherein the surface to be prepared for non-stick coating is thermally sprayed with a substantially Nickel free stainless steel alloy having 3.5–6.0% Aluminum (Al) and 14–23.5% Chromium (Cr).

5. The method of claim 4 wherein the formulation for the substantially Nickel free stainless steel alloy further comprises: 0.45% (maximum) Manganese (Mn), 0.65% (maximum) Silicon (Si), 0.055% (maximum) Carbon (C), and 70.35–74.35 parts iron (Fe).

6. A cooking utensil comprising: a substrate and an intermediate layer deposited on the substrate by thermally spraying said substrate with a substantially Nickel free stainless steel alloy containing at most 6.0% Aluminum.

7. The cooking utensil of claim 6 wherein the substantially Nickel free stainless steel alloy contains from 14–23.5% chromium by weight.

8. The cooking utensil of claim 6 wherein the substantially Nickel free stainless steel alloy contains from 3.5–6.0% by weight of aluminum.

9. The cooking utensil of claim 6 wherein the formulation for the substantially Nickel free stainless steel alloy further comprises: 0.45% (maximum) Manganese (Mn), 0.65% (maximum) Silicon (Si), 0.055% (maximum) Carbon (C), and 70.35–74.35 parts iron (Fe).

10. A method for preparing a surface for application of a non-stick coating, the method in which the surface to be prepared for non-stick coating is thermally sprayed with a substantially Nickel free stainless steel alloy.

11. The method of claim 10 wherein the substantially Nickel free stainless steel alloy contains at most 23.5% Chromium.

12. The method of claim 10 wherein the substantially Nickel free stainless steel alloy contains at most 6.0% aluminum.

13. A cooking utensil comprising: a substrate and a layer deposited upon the substrate by thermally spraying said substrate with a substantially nickel free stainless steel alloy.

14. The cooking utensil of claim 13 wherein the layer deposited upon the substrate by thermally spraying said substrate with a substantially Nickel free stainless steel alloy contains at most 23.5% Chromium.

* * * * *